United States Patent [19]

Gordon

[11] Patent Number: 4,827,563

[45] Date of Patent: May 9, 1989

[54] TANK CLEANING APPARATUS AND METHOD

[76] Inventor: Len C. Gordon, 1601 E. 27th St., Farmington, N. Mex. 87401

[21] Appl. No.: 907,941

[22] Filed: Sep. 16, 1986

[51] Int. Cl.[4] ..... A47L 5/14; A47L 9/06; B08B 3/02; B08B 9/08

[52] U.S. Cl. ..... 15/402; 15/93 R; 134/167 R; 134/181

[58] Field of Search ..... 15/401, 402, 302, 320, 15/395, 93 R, 56, 330, 4, 1.7, 160, 104.1 C, 236 R, 321, 322, 236.01; 134/172, 168 R, 180, 181, 198, 168 C, 167 R, 167 C, 166 R; 366/169, 312, 313; 239/225.1, 246, 264, 556, 566, 532, 587; 210/525, 528; 285/403, 404, 165, 302

[56] References Cited

U.S. PATENT DOCUMENTS

| | | | |
|---|---|---|---|
| 1,951,462 | 3/1934 | Wing | 15/93 R |
| 2,320,976 | 6/1943 | McCartney et al. | 15/93 R X |
| 2,332,940 | 10/1943 | Senke | 15/401 X |
| 2,513,254 | 6/1950 | Savage et al. | 15/93 R |
| 2,748,944 | 6/1956 | Kalinske | 134/180 X |
| 2,980,934 | 4/1961 | Steindorf | 134/167 R X |
| 3,001,534 | 9/1961 | Grant, Jr. | 134/167 R |
| 3,402,725 | 9/1968 | Booth | 134/167 R |
| 3,472,538 | 10/1969 | Vincent et al. | 285/403 X |
| 3,542,593 | 11/1970 | Pribbernow | 134/167 R |
| 4,029,116 | 6/1977 | Beyer | 134/167 R |
| 4,163,455 | 8/1979 | Herbert et al. | 134/167 R |
| 4,521,380 | 6/1985 | Fujimoto | 366/169 X |

*Primary Examiner*—Harvey C. Hornsby
*Assistant Examiner*—Scott J. Haugland
*Attorney, Agent, or Firm*—Sughrue, Mion, Zinn, Macpeak & Seas

[57] ABSTRACT

An apparatus for cleaning the inside of tanks of various dimensions comprises a vertically disposed hollow tube inside the tank connected at its lower end to a hollow radial tube having a series of apertures horizontally disposed there along and having adjacent said apertures a plurality of scrapers, the apertures for permitting fluid under pressure to be directed against the inside walls and bottom wall of the tank the scrapers for providing a scraping action on the bottom wall of said tank. An aperture on the end of the radial tube permits fluid under pressure to be directed against the inside walls of said tank for facilitating removal of sediment. A source of fluid pressure is connected to the upper end of the vertically disposed tube providing the cleaning pressure for said tank.

4 Claims, 1 Drawing Sheet

FIG. 1
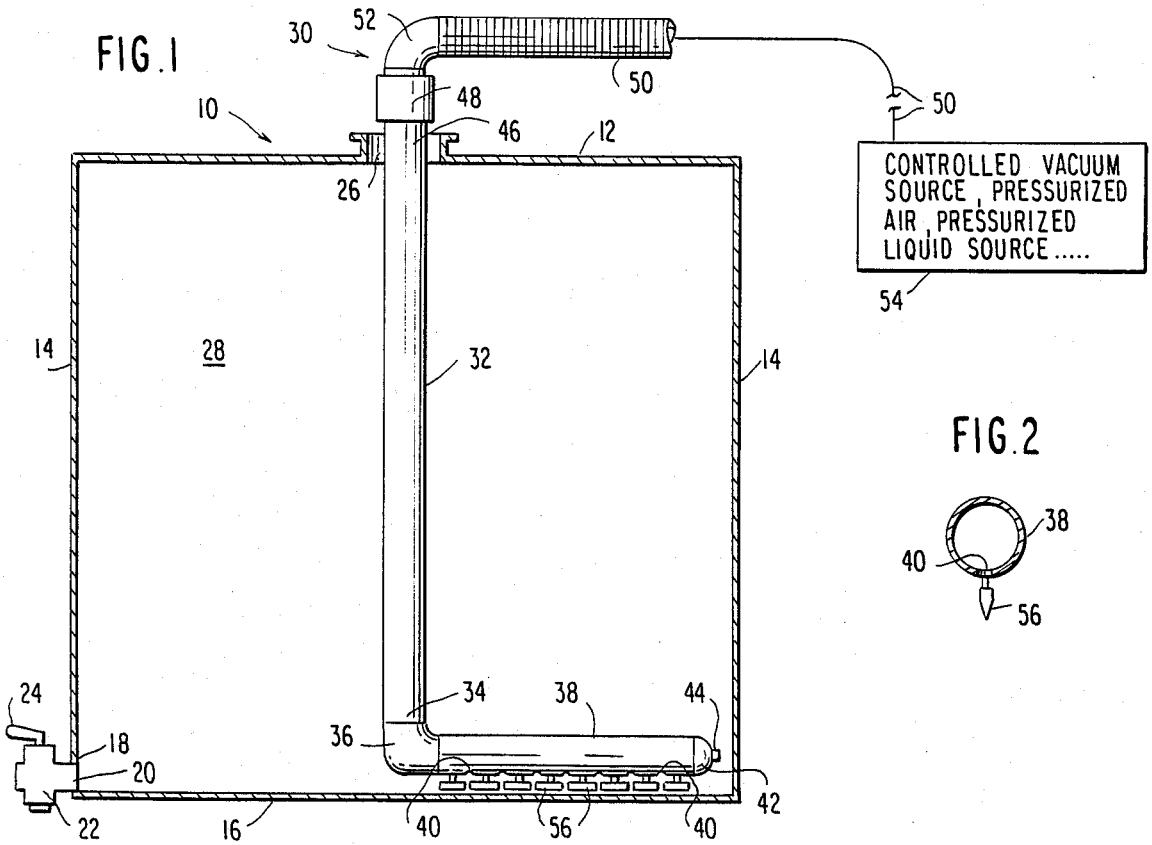
FIG. 2
FIG. 3
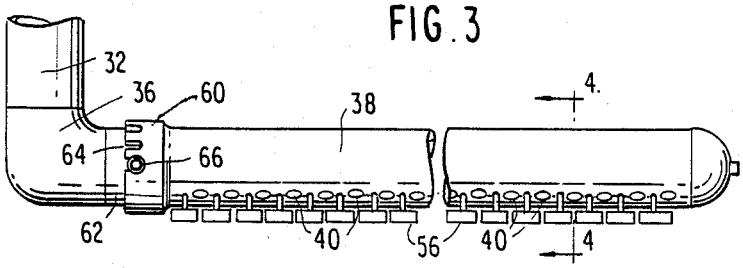
FIG. 4
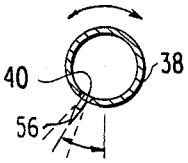
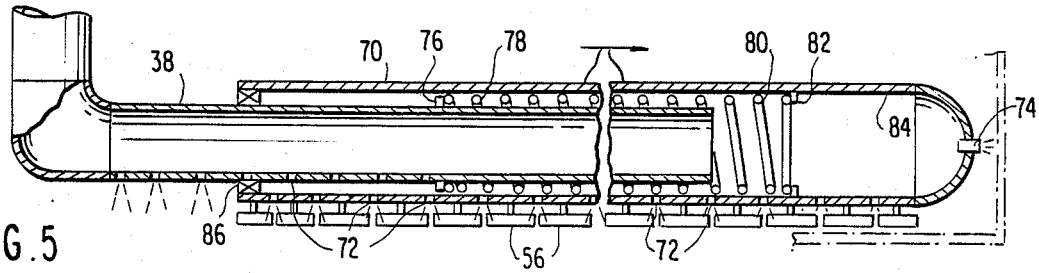
FIG. 5
FIG. 6
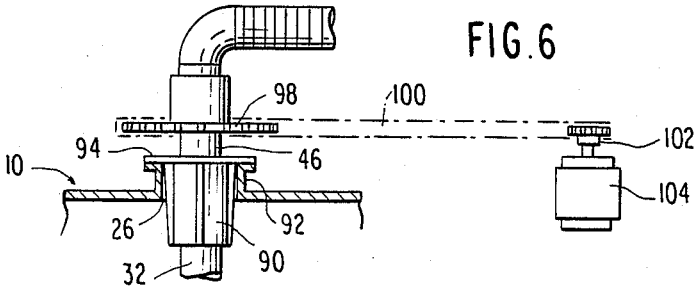

TANK CLEANING APPARATUS AND METHOD

BACKGROUND OF THE INVENTION

1. Field of the Invention

This invention relates to a tank cleaning apparatus and method of accomplishing same. The apparatus and method utilizes a vacuum source, either air or liquid, and a pressure source, either air or liquid.

2. Background of the Prior Art

The prior art shows devices for washing the inside of tanks and utilizes filtering means associated therewith.

SUMMARY OF THE INVENTION

There is a need for a simple yet efficient apparatus and method for cleaning the inside of tanks of any size or shape.

It is therefore one object of this invention to provide an apparatus and method of cleaning tanks of any size and shape utilizing a combination of vacuum by air, suction by liquid combined with air pressure and liquid pressure, singularly or in combination.

It is another object of this invention to provide an apparatus for cleaning tanks comprising a vertical riser tube having a radially extending tube attached thereto with means on the radial tube to provide jet sprays and scraper actions.

These and other objects of the invention will become apparent to those skilled in the art to which the invention pertains from a reading of the specification when taken in light of the annexed drawings.

BRIEF DESCRIPTION OF THE DRAWINGS

FIG. 1 is a cut-away view of a tank having the cleaning apparatus of this invention therein which comprises a vertical riser tube and a radial tube which latter tube provides vertical and horizontal jet actions and scraping actions.

FIG. 2 is an end sectional view of the radial tube of FIG. 1 showing jet openings and scraper blades.

FIG. 3 is a perspective view of the radial tube of FIG. 1 showing the structure by which the tube and jet openings may be angularly changed.

FIG. 4 is an end sectional view of the radial tube taken along the line 4—4 of FIG. 3.

FIG. 5 is a perspective view in section of the radial tube showing internal spring biasing means for facilitating expansion or compression of the radial tube.

FIG. 6 is a perspective view of the means or supporting the vertical riser tube on the tank and the means for rotating same.

DETAILED DESCRIPTION OF THE PREFERRED EMBODIMENT OF THE INVENTION

Turning now to the drawings with more detail. FIG. 1 shows a tank 10 having a top wall 12, side walls 14 and a bottom wall 16. Near the bottom 18 of walls 14 is an opening 20 for receiving a valve 22 having a manually operable handle 24 by which the contents of tank 10 may be emptied.

The top 10 has an opening 26 to permit access to the interior 28 of the tank. The cleaning apparatus 30 of this invention comprises a hollow vertical riser tube 32 which may vary in diameter and height depending on the size of the tank 10 and on the vacuum or suction power necessary to accomplish the cleaning action of a particular job. The lower end 34 of the riser tube 32 has a connector elbow 36 by which a horizontal hollow radial tube 38 may be fastened. The radial tube 38 has a series of vertically oriented horizontally disposed jet openings 40 permitting either liquid under pressure or air under pressure to jet outwardly against the bottom 16 of the tank 10. The horizontal jet opening 44 permits jetting liquid or air against the sides 14 thereby dislodging sediment. The jet openings 40 and 44 permit the application of a vacuum by air or suction by liquid whereby the sediment thus removed from the wall of the tank may be completely removed from the tank. The opening 44 is variable in size whereby liquid or air may be applied under a given pressure to the side walls 14. The various sizes of openings 44 may be accomplished by any suitable means by which the opening 44 may be restricted or enlarged.

The upper end 46 of the riser tube 32 has a swivel connector 48 by which a hose 50 is attached at end 52. This construction permits rotation of the riser tube 32 and radial tube 38 within the tank 10. The opposite end 52 of the hose 50 is attachable to variable pressure or vacuum sources of liquid or air 54. These sources may be singular or in any combination simultaneously.

The radial tube 38 has a series of scraper blades 56 disposed adjacent the jet openings 40 which blades permit scraping of the bottom 16 of the tank to dislodge semi-hardened or hardened sediment thereon.

It is often necessary to vary the angle of the jet openings 40 and the angle of the scraper blades 56. This may be accomplished by rotatably attaching the radial tube 38 to the connector 36, FIG. 3 and 4, by a collar 60 telescoped over end 62. The collar 60 has a plurality of evenly spaced open key ways 64 about the periphery thereof. The key ways 64 cooperate with a key 66 on the end 62 whereby the tube 38 may be rotated and then fixed so that the vertical orientation of the jet openings 40 and scrapers 56 may be predetermined.

FIG. 5 shows a modified form of the invention by which the desired angles may be obtained. The radial tube 38 having jet openings 40 has telescoped over it a hollow tube 70 having a series of vertically disposed horizontally arranged jet openings 72 and a horizontally disposed jet openings 74. The tube 38 has a stop 76 on the outer periphery thereof against which an end of spring 78 abuts. The opposite end of spring 78 abuts against a stop 82 on the inside 84 of the tube 70. The tube 70 sealingly engages the tube 38 by a seal 86 whereby the pressure inside tube 70 is equal to the pressure inside tube 38. As will be appreciated, the tube 70 is biased against the tank wall 14 whereby the jet opening 74 will provide a jet action having maximum effect. Further, the tube 70 may also be rotated in the same fashion as the tube 38 in FIG. 4 which will permit the jet openings 72 to be changed to various angles with respect to the bottom 16 of the tank. The scrapers (not shown) adjacent the opening 72 are simultaneously varied to change their angle with respect to the bottom of the tank 16.

A further embodiment of the invention is shown in FIG. 6 wherein the tank 10 has a top 12 with opening 26. The end 46 of the riser tube 32 is rotatable in connector 90 which is tightly engaged in the opening 26 against nipple 92. A closure 94 functions to close the opening 26. Journaled on the end 46 of riser tube 32 above connector 90 is a sprocket wheel 98 about which is trained a chain 100 which is attached at the opposite end to sprocket wheel 102 of motor 104. The motor 104 is supported on any suitable support and its operation thereof causes rotation of the riser tube 32 and the radial tube 38.

In operation, the riser tube 32 and radial tube 38 are inserted through the opening 26 in top 12 of tank 10. The operator holds the riser tube 32 such that the radial tube 38 is horizontally disposed adjacent the inside of top 12. The operator then applies a vacuum source or a pressure source which exits jet opening 44 against the walls 14. The operator rotates the riser tube 32 whereby the radial tube 38 is caused to rotate about the walls 14 cleaning the walls by the jet action issuing from jet opening 44. The operator slowly moves the riser tube downwardly in the tank which action completely removes sediment from the walls 14. As the radially tube 38 reaches the floor 16, the pressure from the jet openings 40 dislodges loose sediment on the floor 16. Semi-hardened or hardened sediment is removed by the action of scrapers 56 scraping the bottom of floor 16. The operator may then apply a source of pressurized liquid or air to completely clean the bottom wall and side walls and thereafter apply a vacuum source to remove the sediment from the tank.

While the invention has been described with regard to a specific embodiment thereof, it will be understood by those skilled in the art to whom the invention pertains that numerous changes may be made in the invention without departing from the spirit of scope thereof.

What is claimed is:

1. An apparatus for cleaning a substantially hollow cylindrical tank having a vertical axis comprising:

a hollow vertical tube insertable into said tank through an opening for vertical and rotary movement within the tank relative to the vertical axis thereof;

a hollow radial tube connected at one end thereof to an end of said vertical tube in internal communication therewith and extending perpendicular thereto;

said radial tube having a plurality of downwardly directed horizontally spaced openings therein and a horizontally disposed opening at the opposite end thereof adjacent an inside wall of said tank;

a plurality of downwardly extending scraper blades horizontally disposed below said radial tube and adjacent said openings for contact with a bottom wall of said tank; and means for selectively connecting said vertical tube and said radial tube to sources of fluid under vacuum and pressure, whereby the inside wall and bottom wall of the tank can be cleaned by a fluid under pressure from said openings and the bottom wall is scraped by said scrapers and whereby fluid-entrained sediment is removed by said fluid under vacuum.

2. An apparatus as set forth in claim 1 further comprising adjusting means for permitting said radial tube to be adjustably rotated to vary the angle at which said fluid under pressure is directed against the bottom wall of the tank.

3. An apparatus as set forth in claim 1 further comprising power driven means upwardly connected to said vertical tube for rotating said vertical tube about a longitudinal axis thereof.

4. An apparatus as set forth in claim 1, wherein said hollow radial tube is connected to said vertical tube for sliding movement toward and away from said vertical tube and further comprising spring means normally biasing said hollow radial tube outwardly toward a cylindrical wall of said tank.

* * * * *